US007717755B2

(12) United States Patent
Zhang et al.

(10) Patent No.: US 7,717,755 B2
(45) Date of Patent: May 18, 2010

(54) ELECTRICAL CONNECTOR WITH IMPROVED CONTACTS

(75) Inventors: Han-Ming Zhang, ShenZhen (CN); Tsuneki Watanabe, Yokohama (JP)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/380,335

(22) Filed: Feb. 25, 2009

(65) Prior Publication Data

US 2009/0275245 A1 Nov. 5, 2009

(30) Foreign Application Priority Data

Apr. 30, 2008 (CN) ..... 2008 2 0035886

(51) Int. Cl.
*H01R 24/04* (2006.01)

(52) U.S. Cl. ..... 439/669

(58) Field of Classification Search ..... 439/668, 439/669

See application file for complete search history.

(56) References Cited

U.S. PATENT DOCUMENTS 6,908,343 B1 * 6/2005 Hu ..... 439/668
7,285,024 B1 * 10/2007 Tai ..... 439/668
2007/0249235 A1 * 10/2007 Wu ..... 439/668

FOREIGN PATENT DOCUMENTS

TW M298826 10/2006

* cited by examiner

*Primary Examiner*—Neil Abrams
(74) *Attorney, Agent, or Firm*—Ming Chieh Chang; Wei Te Chung; Andrew C. Cheng

(57) ABSTRACT

An electrical connector (100) includes an insulative housing (1) and at least one contact (2) received and retained in the housing. The housing defines a mating face (10), a receiving cavity (101) running through the mating face for receiving a mating connector (200) and at least one groove (131) disposed at a sidewall of the receiving cavity and communicating with the receiving cavity. The at least one contact defines a retaining portion (21) retained in the at least one groove, a contacting portion (23) bending into the cavity and at least one guiding portion (24) extending from the contacting portion along a mating direction for guiding the mating connector to enter into the receiving cavity, and a free edge (241) of the at least one guiding portion extends into the corresponding at least one groove.

11 Claims, 6 Drawing Sheets

ELECTRICAL CONNECTOR WITH IMPROVED CONTACTS

BACKGROUND OF THE INVENTION

1. Field of the Invention

The present invention relates to an electrical connector, and more particularly to an electrical connector having improved contacts for guiding a mating connector.

2. Description of the Related Art

Taiwan Patent Issued Number M298826 discloses an electrical connector including an insulative housing and a plurality of contacts retained in the housing. The housing defines a receiving cavity running through a front face thereof for receiving a mating connector therein and a plurality of receiving grooves disposed at two sidewalls thereof. The receiving grooves are disposed at two sides of the receiving cavity and communicate with the receiving cavity. The contacts include a plurality of first contacts and a pair of switching contacts. Each of the first contacts defines a retaining portion and a resilient arm extending therefrom, and a contacting portion is defined at a free end of the resilient arm by projecting into the receiving cavity for contacting with the mating connector.

However, the mating connector may scrape a front edge of the contacting portions when the mating connector is inserted into the receiving cavity. Moreover, the contacts will be crushed if the inserting force of the mating connector is big, which will make the electrical connector be destroyed. Therefore, a new design to solve the problem is required.

SUMMARY OF THE INVENTION

An object of the present invention is to provide an electrical connector with contacts having guiding portions for guiding a mating connector.

In order to achieve above-mentioned objects, an electrical connector includes an insulative housing and at least one contact received and retained in the housing. The housing defines a mating face, a receiving cavity running through the mating face for receiving a mating connector and at least one groove disposed at a sidewall of the receiving cavity and communicating with the receiving cavity. The at least one contact defines a retaining portion retained in the at least one groove, a contacting portion bending into the cavity and at least one guiding portion extending from the contacting portion along a mating direction for guiding the mating connector to enter into the receiving cavity, and a free edge of the at least one guiding portion extends into the corresponding at least one groove.

Other objects, advantages and novel features of the invention will become more apparent from the following detailed description of the present embodiment when taken in conjunction with the accompanying drawings.

DETAILED DESCRIPTION OF THE INVENTION

Figure 1:
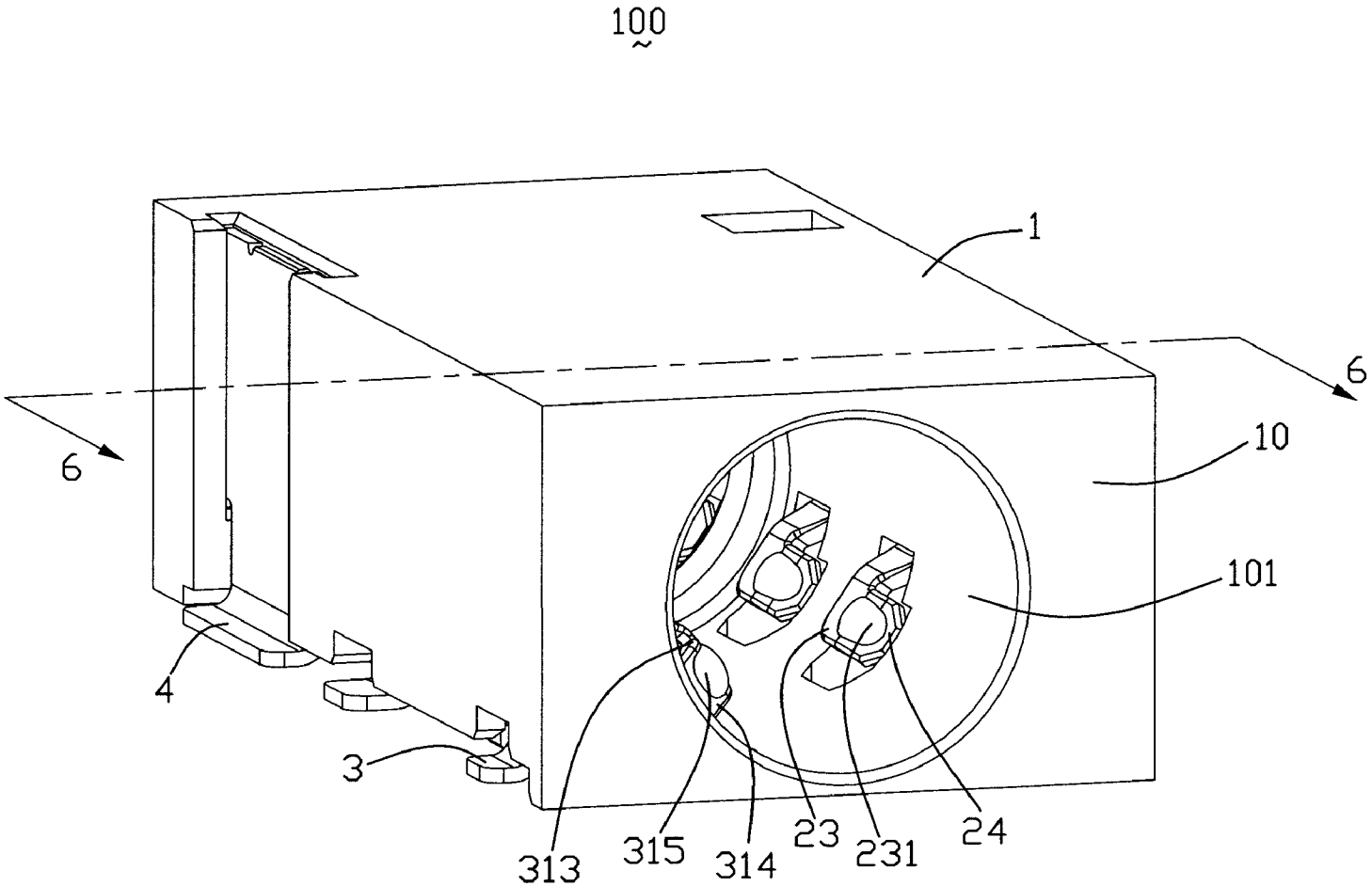
FIG. 1 is a perspective view of an electrical connector in accordance with the present invention.

Reference will now be made to the drawing figures to describe the preferred embodiment of the present invention in detail.

Figure 2:
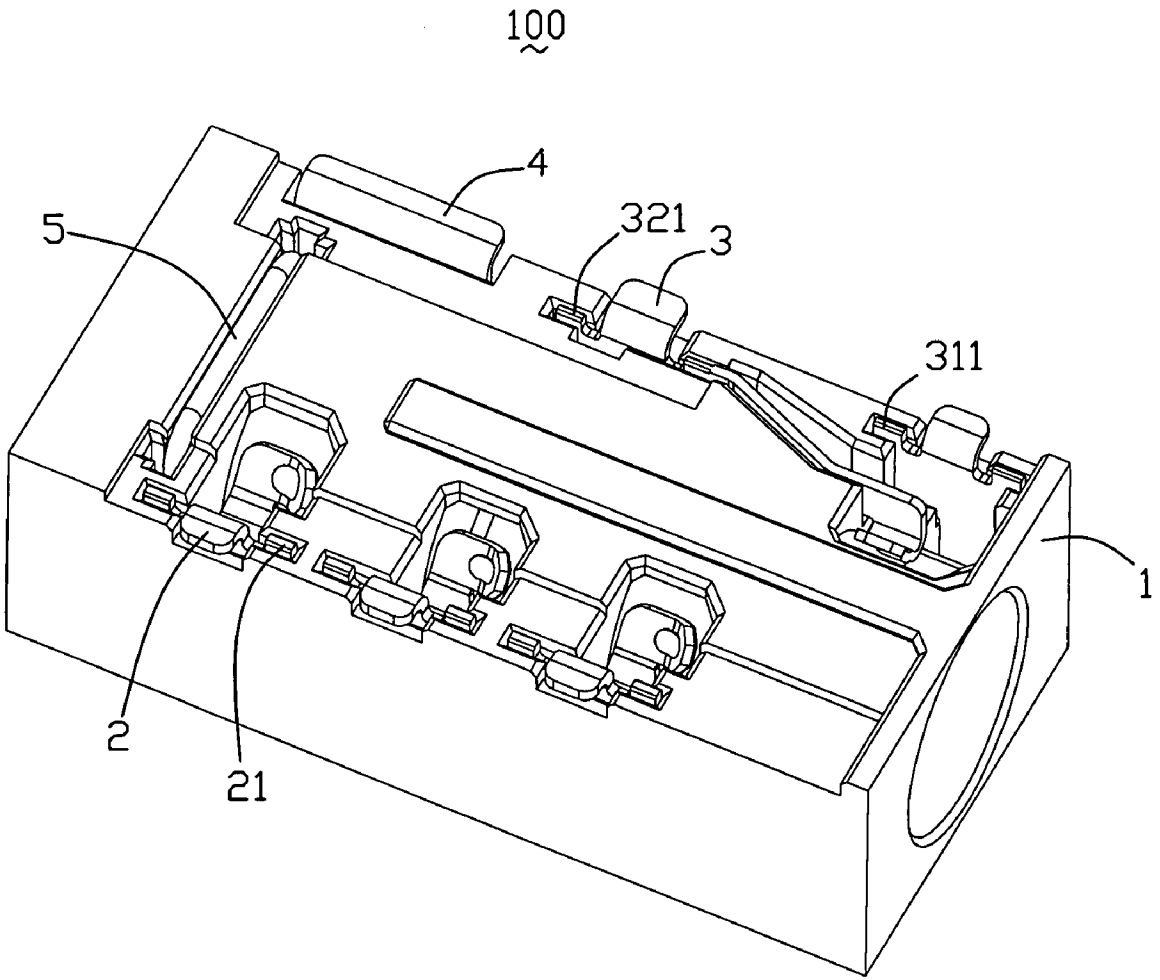
FIG. 2 is another perspective view of the electrical connector shown in FIG. 1.

Referring to FIG. 1 and FIG. 2, an electrical connector 100, preferably an audio jack, includes an insulative housing 1, a plurality of electrical contacts 2, 3 received in the housing 1, a retaining member 4 and a clip member 5.

Figure 3:
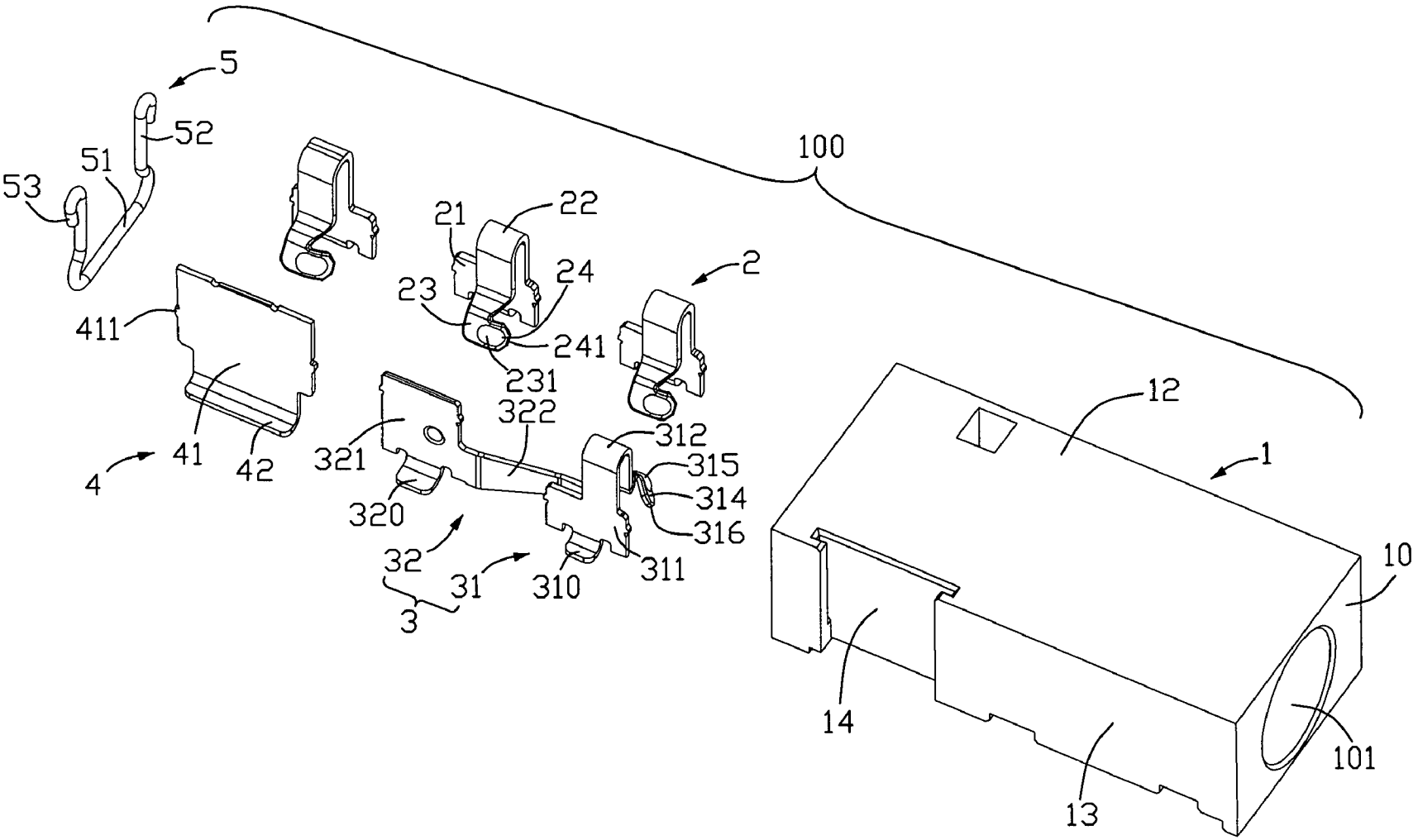
FIG. 3 is an exploded perspective view of the electrical connector shown in FIG. 1.
Figure 4:
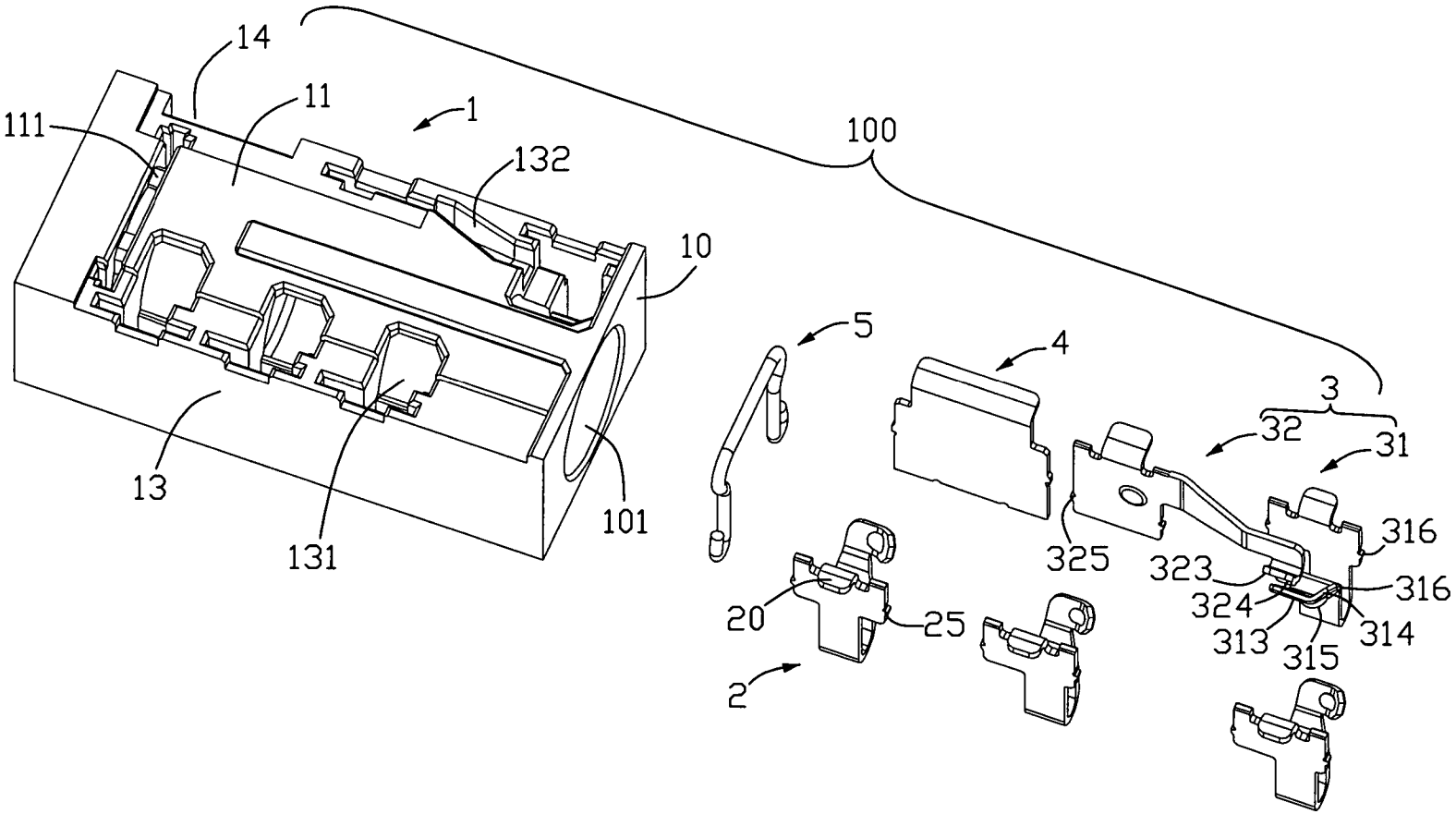
FIG. 4 is another exploded perspective view of the electrical connector shown in FIG. 3.

Referring to FIG. 3 and FIG. 4, the housing 1 of a rectangular configuration defines a front/mating face 10 and a bottom face or mounting face 11 perpendicular to the front face and a pair of sidewalls 13 perpendicular to the front face and bottom face. A columnar receiving cavity 101 runs through the front face 10 and is surrounded by the sidewalls 13 and the bottom and top faces. A plurality of terminal grooves 131, 132 disposed in opposite sidewalls 13 are defined communicating with the receiving cavity 101 and an exterior through the bottom face 11. The housing further defines a slot 111 recessed from the bottom face 11 and communicating with the receiving cavity 101.

Three first terminals 2 of similar configuration are arranged in one of the sidewall 13. Each of the terminal includes a retaining portion 21 with bars at lateral sides thereof, a soldering portion 20 extending to the bottom face 11 from the retaining portion 21 and bending outwards, and a resilient arm 22 extending upwards and then bending downwards. A contacting portion 23 is defined at a free end of the resilient arm 22 by bending towards the cavity 101, with a protruding contacting point 231 thereof and a guiding portion 24 extending forwards from a front edge of the contacting portion 23. The contacting point 231 is partly disposed at the guiding portion 24 in this embodiment. Alternatively, the contacting point 231 may be completely set on the guiding portion 24 or apart from the guiding portion 24. The three terminals are received in the corresponding grooves 131 from the mounting face 11. The guiding portions 24 protrude into the cavity 101 with the free edge 241 adjacent to the front face 10 extending into the terminal grooves 131.

A second terminal 31 are same to the first terminal 2 and received and retained in a groove 132 in the front end of another sidewall 13. The second terminal 31 also defines a guiding portion 314 extending forwards from a front edge of the contacting portion 313. The third terminal 32 includes a retaining portion 321 with bars thereon, a resilient arm 322 extending forward from a front edge of the retaining portion 321 and a soldering portion 320 bending outward from a bottom edge of the retaining portion 321. A contacting portion 323, which bends toward the bottom face 11 from a top edge of the resilient arm 22, is provided at a free end of the resilient arm 322 with a contacting point 324 thereon. The second terminal 31 and the third terminal 32 are received in corresponding grooves 132 defined at the sidewall 13 from the mounting face 11, and form a detecting pair 3. A free edge 316 of the guiding portion 314 extends into the terminal grooves 132.

Referring to FIG. 2 to FIG. 4, the retaining member 4 includes a retaining portion 41 with barbs 411 received and interfered with a slot 14 behind the grooves 132, and a soldering portion 42 to be connected with a PCB as the soldering portions of the terminals.

The clip member 5 is of substantial arc-shape, and includes a connecting portion 51 substantially parallel to the bottom face 11 of the housing 1, a pair of resilient arm 52 bending from two opposite ends of the connecting portion 51, and a pair of clamping portions 53 each extending from the end portion apart from the connecting potion 51 of the resilient arm 52. The clip member 5 is received and retained to the housing 1 by the clamping portions 53 engaging with the slot 111, and the connecting portion 51 is positioned at an opening of the slot 111 at the bottom face 11 of the housing 1 and the resilient arms 52 project into the receiving cavity 101 for clipping a mating connector 200 (shown in FIG. 5).

Figure 5:
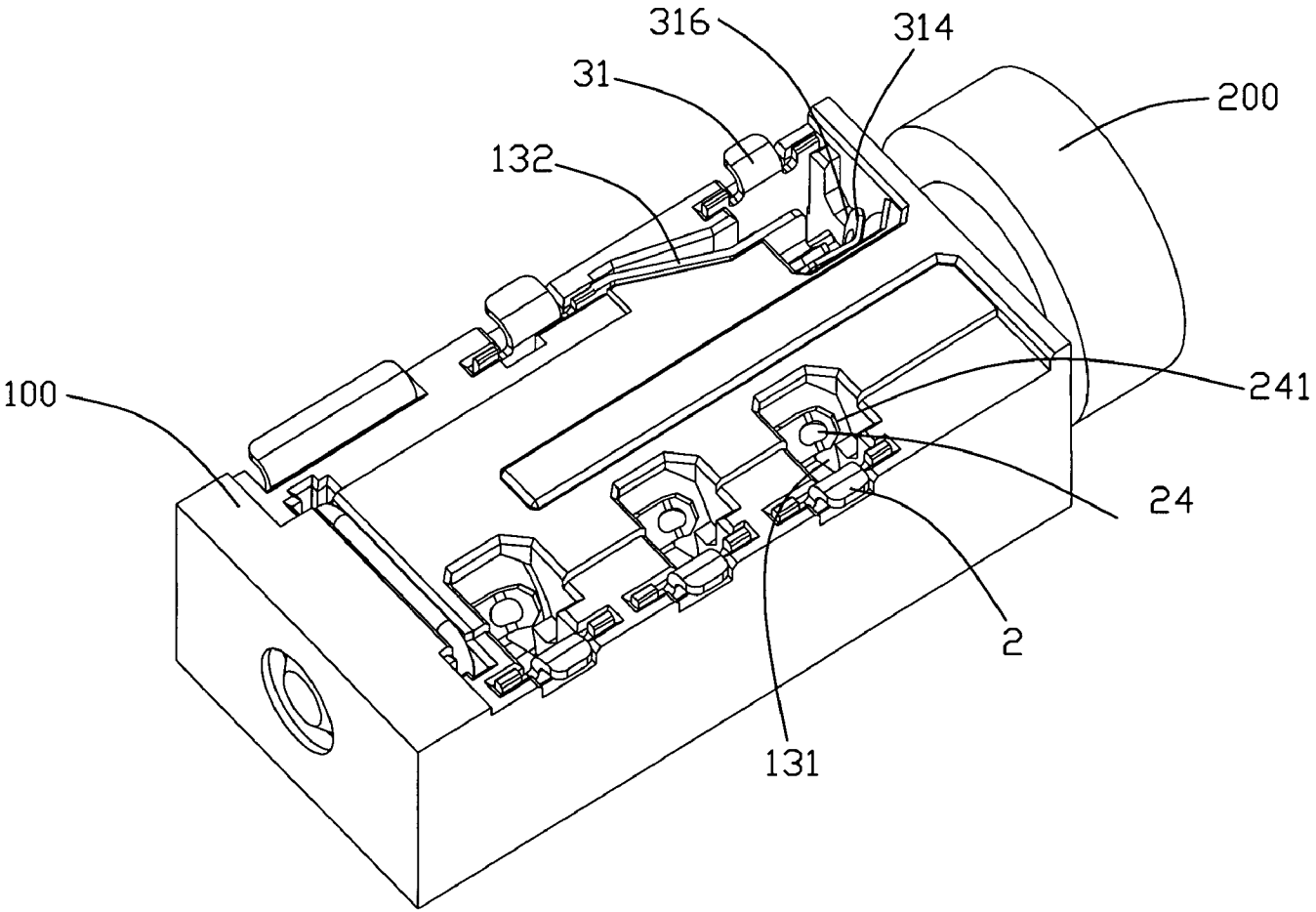
FIG. 5 is a perspective view of the electrical connector mating with a mating connector.

Referring to FIG. 1, FIG. 3 and FIG. 5, when the electrical connector 100 is mating with the mating connector 200, the guiding portions 24, 314 may guide the mating connector 200 to enter into the receiving cavity 101 smoothly. Then, the contacting portions 23, 313 may separately connect with the mating connector 200 by the contacting points 231, 315. When the mating connector 200 is completely inserted into the receiving cavity 101, the free end of the mating connector 200 will enter into the clip member 5 and be clipped between the pair of resilient arms 52 steadily.

The improved contacts having guiding portions 24, 314 may guide the mating connector 200 entering into the receiving cavity 101 smoothly. Moreover, the free edges 241, 316 of the guiding portions 24, 314 further enter into the corresponding grooves 131, 132 may prevent the front edges 241, 316 from being scraped to cause the contacts be destroyed easily. The contacting points 23, partly disposed on the guiding portions not only can contact with the mating connector 200, but also have a guiding function for guiding the mating connector 200.

Figure 6:
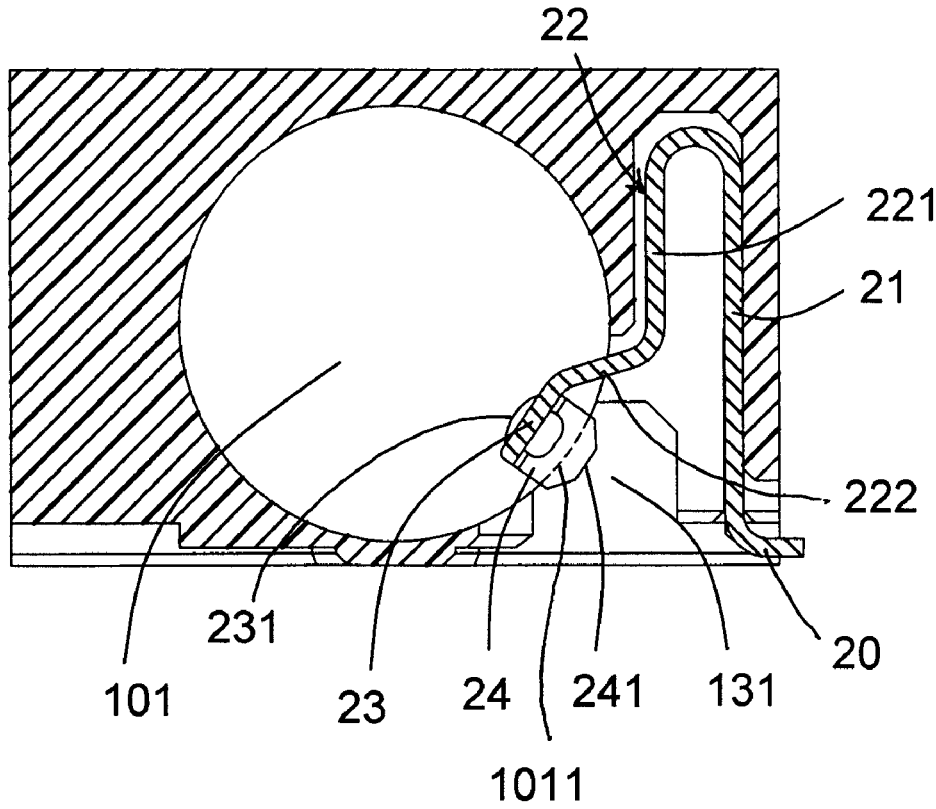
FIG. 6 is a front cross-sectional view of FIG. 1 taken along line 6-6.

Referring to FIG. 6, it is noted that in the first terminal 2, the resilient arm 22 essentially includes a first section 221 located outside of the receiving cavity 101 and parallel to the retaining portion 21, a second section 222 extending from the first section 221 into the receiving cavity 101 and angled to the first section 221. The contacting portion 23, which is linked to the end (not labeled) of the second section 222, extends essentially along an axial direction and is fully located in the receiving cavity 101 and angled to both said first section 221 and the second section 222 while roughly compliant with a corresponding arc section 1011 of the receiving cavity 101 (shown in the dashed line in FIG. 6) in the radial direction. The three segmental type arrangement of the resilient arm 22 (including the first section 221 and the second section 222) and the contacting portion 23, allows the contacting portion 23 and the corresponding guiding portion 24 to be more compliant with the plug inserted into the receiving cavity 101. Thus, deflection of the resilient arm 22 corresponding to insertion of the plug is smoother, advantageously.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a mating face, a cylindrical receiving cavity running through the mating face for receiving a mating connector in a front-to-back direction and defining a central axis, at least one groove disposed at a sidewall of the receiving cavity and communicating with the receiving cavity; and at least one contact disposed in the housing, including a retaining portion retained in the at least one groove, a resilient arm from which a contacting portion extending, said resilient extending upwards and then bending downwards from the retaining portion, said contacting portion projecting into the receiving cavity and being deflectable in a plane which is perpendicular to said front-to-back direction, and a guiding portion extending from the contacting portion in a direction oblique to and away from the central axis and toward the mating face, said guiding portion extending along said front-to-back direction in a side view, said resilient arm and the guiding portion commonly defined an L-shaped configuration in said side view, a free edge of the guiding portion extending into the corresponding at least one groove.

2. The electrical connector as claimed in claim 1, wherein the contacting portion defines a contacting point thereon projecting into the receiving cavity, and the contacting point is partly disposed on the guiding portion.

3. An electrical connector comprising:

an insulative housing defining a columnar receiving cavity extending in a front-to-back direction and defining a central axis, said receiving cavity communicating with an exterior through a front opening of the housing;

a plurality of contacts disposed in the housing, each of said contacts including a retaining section, a resilient arm extending from the retaining section and being deflectable outwards away from said central axis, the resilient arm including a first section located outside of the receiving cavity and parallel to the retaining section in a front view, and a second section extending from the first section into the receiving cavity and angled to the first section in the front view, and a contacting portion linked to an end of the second section and extending essentially along an axial direction and being fully located in the receiving cavity and angled to both said first section and said second section in the front view, and a guiding portion extending both axially and radially from an end of the contacting portion in a direction oblique to and outwardly away from central axis and toward the front opening.

4. The electrical connector as claimed in claim 3, wherein both said first section and said second section of the resilient arm do not extend along said axial direction.

5. The electrical connector as claimed in claim 3, wherein a front edge of the guiding portion is hidden in a groove recessed outwards from an inner surface of the receiving cavity.

6. The electrical connector as claimed in claim 5, wherein the groove is disposed at a sidewall of the receiving cavity for receiving a contact having the corresponding second elastic section.

7. An electrical connector comprising:

an insulative housing defining a columnar receiving cavity extending in a front-to-back direction and defining a center axis, said receiving cavity communicating with an exterior through a front opening of the housing;

a plurality of contacts disposed in the housing, each of said contacts defines a U-shaped main body having an outer arm from which the retaining section and the soldering section extend, and an inner arm from a free end of which a contact section extending forwardly along an axial direction, said contact section being deflectable outwardly away from the center axis, and a guiding section extending axially and forwardly from the contact section in a direction oblique to and away from the center axis toward the front opening; wherein said inner arm includes an upper first section essentially parallel to the outer arm, and a lower second section extending from and angled with the first section downwardly under condition that both said first section and said section do not extend along said axial direction but keeping at a same axial position, while said contact section extends along the axial direction and keeping in a same radial direction.

8. The electrical connector as claimed in claim 7, wherein said guiding section extends along said front-to-back direction in a side view.

9. The electrical connector as claimed in claim 3, wherein said guiding section extends in a radial direction with regard to axis in a front view.

10. The electrical connector as claimed in claim 7, wherein a front edge of said guiding section extending beyond an inner surface of the receiving cavity to enter into a groove communicating with the receiving cavity.

11. The electrical connector as claimed in claim 10, wherein the groove is disposed at a sidewall of the receiving cavity for receiving a contact having the corresponding guiding section.

* * * * *